US005245253A

United States Patent [19]

Quazi

[11] Patent Number: 5,245,253

[45] Date of Patent: Sep. 14, 1993

[54] ELECTRONIC DIMMING METHODS FOR SOLID STATE ELECTRONIC BALLASTS

[75] Inventor: Fazle S. Quazi, Boulder, Colo.

[73] Assignee: ETTA Industries, Boulder, Colo.

[21] Appl. No.: 410,480

[22] Filed: Sep. 21, 1989

[51] Int. Cl.[5] ..... H05B 37/02; H05B 39/04; H05B 41/36

[52] U.S. Cl. ..... 315/224; 315/DIG. 4; 315/287

[58] Field of Search ..... 315/224, DIG. 4, 291, 315/287

[56] References Cited

U.S. PATENT DOCUMENTS

| | | | |
|---|---|---|---|
| 4,379,254 | 4/1983 | Hurban | 315/DIG. 4 |
| 4,388,563 | 6/1983 | Hyltin | 315/DIG. 4 |
| 4,395,660 | 7/1983 | Waszkiewicz | 315/DIG. 4 |
| 4,626,746 | 12/1986 | Zaderej | 315/287 |
| 4,949,020 | 8/1990 | Warren et al. | 315/DIG. 4 |

*Primary Examiner*—Robert J. Pascal
*Assistant Examiner*—Tan Dinh
*Attorney, Agent, or Firm*—Sixbey, Friedman, Leedom & Ferguson

[57] ABSTRACT

A circuit and method for controlling a power supply are disclosed, with specific application to dimming of a resonant inverter solid-state fluorescent lamp ballast. The control circuit produces a pulse train signal with pulses of variable duty cycle. The signal is integrated to provide a DC signal which the solid-state ballast uses to control the level of dimming of the lamp. When the duty cycle of the pulses is increased, the level of the DC signal increases, so that the ballast dims the lamp. Conversely, reduction of the pulse duty cycle increases the brightness of the lamp. The control circuit incorporates delay circuitry which suppresses the pulse output at powerup, so that the lamp starts at full intensity. Thereafter, the delay circuitry adjusts the pulse signal so that the lamp intensity is adjusted smoothly to the desired level. A reset circuit resets the delay circuitry in case of a momentary power failure so that the lamp will restart at full intensity and then smoothly dim to the desired intensity, rather than starting at a low intensity. A brightness control circuit allows the user to set the desired light intensity, and an adjustable pulse control circuit allows limitation of the maximum amount of dimming. Overcurrent circuitry disables pulse output if excessive current is drawn from the circuit.

10 Claims, 5 Drawing Sheets

ELECTRONIC DIMMING METHODS FOR SOLID STATE ELECTRONIC BALLASTS

TECHNICAL FIELD

The present invention relates generally to a method and circuit for controlling power supplies. The method is particularly useful in a dimming circuit for fluorescent lamps operating with solid-state electronic ballasts.

BACKGROUND OF THE INVENTION

In recent years, the fluorescent lamp, which requires less energy than the incandescent lamp to produce the same amount of light, has enjoyed increasing popularity. In many modern offices, fluorescent lamps are used to the complete exclusion of incandescent lamps. However, the energy efficient fluorescent lamp has not replaced incandescent lamps to the same extent in other applications.

Since the advent of electrical lighting, people have desired to vary the brightness of lamps, so that a single lamp or group of lamps can provide varying light levels appropriate for a variety of activities. Dimming circuits for incandescent lamps have been well-known for many years, but dimming circuits for fluorescent lamps are more difficult to construct; previous efforts at producing effective fluorescent lamp dimmers have not been entirely successful. This is especially true when dealing with reliable lamp starting and maintaining optimum lamp life.

The present inventor's copending U.S. patent applications, now issued as U.S. Pat. Nos. 4,933,605 and 4,864,482, disclose a solid-state resonant inverter fluorescent ballast circuit which overcomes many of the problems associated with dimming fluorescent lamps. However, to achieve the highest functionality possible, a fluorescent dimming circuit should compensate for several inherent disadvantages of the fluorescent lamp relative to the incandescent lamp. First, fluorescent lamps must be "started" at full intensity. Generally, these lamps will not "start" at all at reduced intensity. In any case, low intensity startups will reduce their lifespan. Second, fluorescent lamps glow as a result of continuous excitation. The level of excitation can be reduced after the initial startup, but even a momentary interruption in this reduced excitation will put the lamp out, so that it must be restarted with greater excitation. Finally, excitation of fluorescent lamps requires storage of potentially dangerous charges, so that it becomes important that the controls for the lamps be isolated from the excitation circuitry.

An efficient, reliable, and useful fluorescent dimming system could be produced by providing the inventor's solid-state, resonant inverter dimming ballast for fluorescent lamps with a simple, reliable solid-state control circuit that compensates automatically for the disadvantages of the fluorescent lamp as described above.

SUMMARY OF THE INVENTION

Therefore, it is a general object of the present invention to provide a novel and improved control method and circuit for controlling power supplies that are responsive to a control voltage input.

It is another general object of the invention to provide a novel and improved system for dimming fluorescent or high intensity discharge lamps while maintaining optimum lamp life and as well as ensuring lamp starting under all conditions.

A more specific object of the present invention is to provide a new and improved control system for dimming fluorescent lamps by creating an initial blocking period for lamp starting and by generating a pulse train signal with pulses of variable duty cycle, wherein the duty cycle of the pulses determines the brightness of the fluorescent lamp.

Another object of the present invention is to provide a new and improved control system for dimming fluorescent lamps by generating a pulse train signal with pulses of variable duty cycle, wherein the pulse train signal is integrated to produce a DC level signal which may be applied as a control signal to a solid-state dimming ballast.

Yet another object of the present invention is to provide a new and improved control system for dimming fluorescent lamps which starts the lamps at full intensity, then dims the lamps to the desired level.

Another object of the present invention is to provide a new and improved control system for dimming fluorescent lamps which detects the occurrence of lamp-extinguishing momentary power interruptions and restarts the lamps at full intensity, thereafter dimming the lamps to the desired level.

A further object of the present invention is to provide a new and improved control system for dimming fluorescent lamps, the system having a user-adjustable brightness control, wherein another control, separate from the brightness control, sets the maximum amount of dimming selectable through the brightness control to prevent inadvertent damage to the lamps and circuitry or excessive reduction of light levels.

A final object of the present invention is to provide a new and improved control system for dimming fluorescent lamps wherein low-voltage, solid-state control circuitry is provided, this circuitry being electrically isolated from the ballast circuitry driving the fluorescent lamps.

Other objects of the present invention will become apparent to those skilled in the art upon review of the specification, claims, and associated drawings.

These objects and others are achieved by providing a circuit and method for controlling a power supply, with particular application to dimming of a resonant inverter solid-state fluorescent lamp ballast. The control circuit produces a pulse train signal with pulses of variable duty cycle. The signal is integrated to provide a DC signal which the solid-state ballast uses to control the level of dimming of the lamp. When the duty cycle of the pulses is increased, the level of the DC signal decreases, so that the ballast dims the lamp. Conversely, reduction of the pulse duty cycle increases the brightness of the lamp.

The control circuit incorporates delay circuitry which suppresses the pulse output at powerup, so that the lamp starts at full intensity. Thereafter, the delay circuitry adjusts the pulse signal so that the lamp intensity is adjusted smoothly to the desired level. A reset circuit resets the delay circuitry in case of a momentary power failure so that the lamp will restart at full intensity and then smoothly dim to the desired intensity, rather than starting at a low intensity. A brightness control circuit allows the user to set the desired light intensity, and an adjustable pulse control circuit allows limitation of the maximum amount of dimming. Overcurrent circuitry disables pulse output if excessive current is drawn from the circuit.

DETAILED DESCRIPTION OF THE PREFERRED EMBODIMENTS

Figure 1:
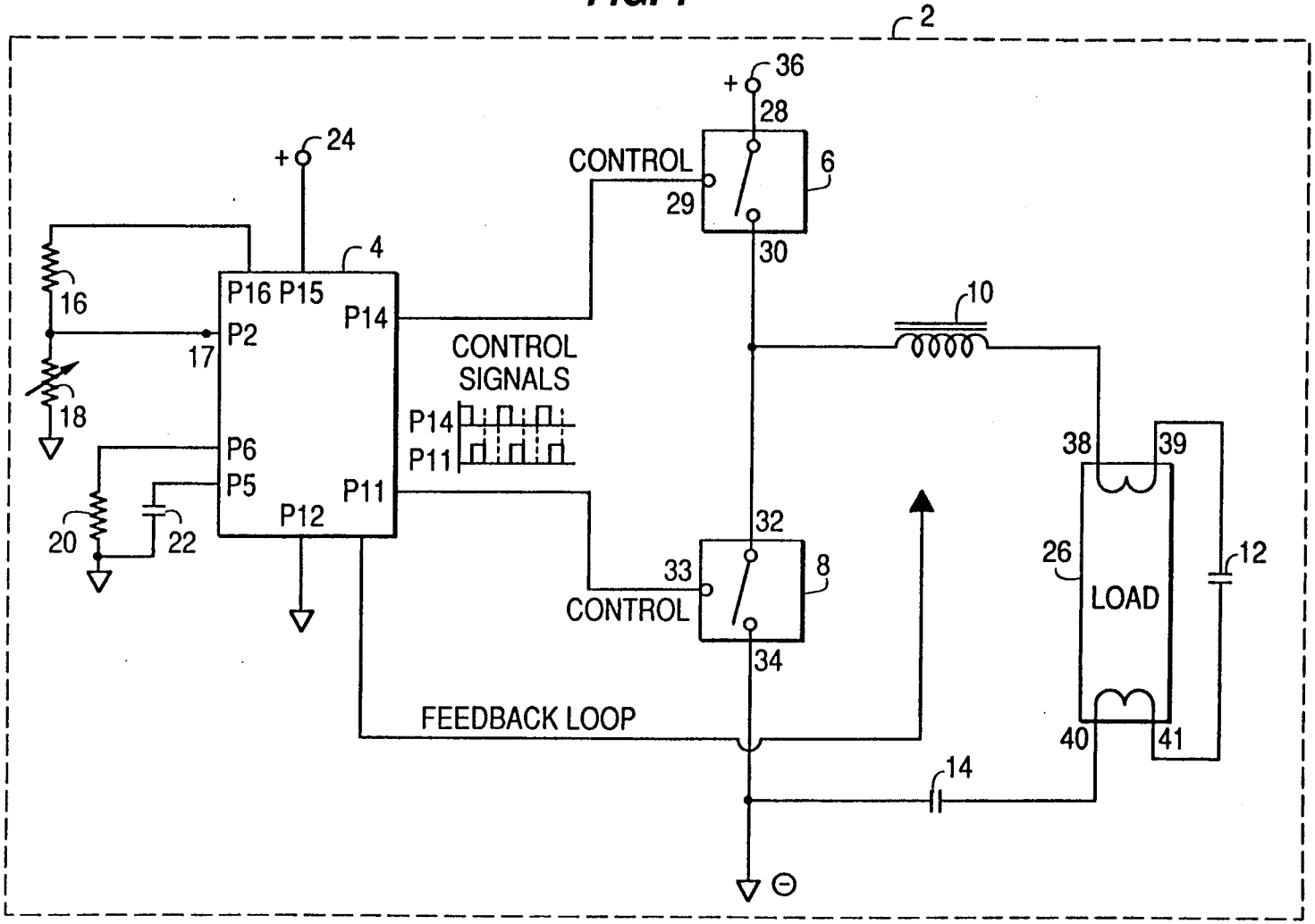
FIG. 1 is a circuit diagram solid-state electronic ballast as disclosed in the inventor's prior U.S. patent applications.

Referring first to FIG. 1, a resonant inverter solid-state dimming ballast circuit is shown generally at 2. While a brief description of the construction and operation of this circuit will be provided here, the solid-state dimming ballast 2 is described completely in the inventor's copending U.S. patent applications, Ser. Nos. 147,574 (filed Jan. 19, 1988) and 216,198 (filed Jul. 7, 1988), the disclosures of which are incorporated herein by reference.

As shown in FIG. 1, the solid-state dimming ballast 2 comprises pulse width modulator 4, power switches 6 and 8, resonant inductor 10, resonant capacitor 12, blocking capacitor 14, voltage divider resistor 16, variable resistor 18, oscillator resistor 20, oscillator capacitor 22, and load 26. Load 26 is provided with four terminals 38, 39, 40 and 41. The load 26 may preferably be a fluorescent tube and will frequently be described as such herein.

The pulse width modulator 4 may be a conventional integrated circuit such as a Motorola SG-2525, used with the following terminal connections: Vcc (pin 15) is connected to a DC voltage source 24, while the Ground terminal (pin 12) is connected to ground. The RT terminal (pin 6) is connected through oscillator resistor 20 to ground, and the CT terminal (pin 5) is connected through the oscillator capacitor 22 to ground. Vref (pin 16) is connected to one terminal of voltage divider resistor 16. The other terminal of voltage divider resistor 16 is connected to the Noninverting Input 17 (pin 2) of pulse width modulator 4 and also connected to ground through variable resistor 18. Output A (pin 11) and Output B (pin 14) of pulse width modulator 4 are connected respectively to control terminals 33 and 29 of power switches 8 and 6 respectively.

The power switches 6 and 8 may be of any suitable solid-state or mechanical construction. Power switch 6 is provided with two switching terminals 28 and 30, and power switch 8 likewise has two switching terminals 32 and 34. Each of the power switches 6 and 8 are also provided with a control terminal 29 and 33 as described previously. In response to a signal pulse on the control terminal 29 produced by the pulse width modulator 4, the power switch 6 will internally connect power terminals 28 and 30 so that devices connected to power terminal 28 will be electrically connected with devices connected to power terminal 30. The power switch 8 likewise connects power terminals 32 and 34 in response to a signal pulse from the pulse width modulator 4 transmitted to the control terminal 33 of power switch 8.

A positive DC source 36 is connected to power terminal 28 of power switch 6, and power terminal 30 is connected both to the power terminal 32 of power switch 8 and to one terminal of resonant inductor 10. The other terminal of resonant inductor 10 is connected to terminal 38 of load 26. Power terminal 34 of power switch 8 is connected both to ground and to one terminal of the blocking capacitor 14. The other terminal of blocking capacitor 14 is connected to terminal 40 of fluorescent tube (load) 26, the terminal 40 being at the opposite end of the tube from terminal 38. The resonant capacitor 12 is connected across terminals 39 and 41 of the fluorescent tube 26.

Oscillator resistor 20 and oscillator capacitor 22 together control the frequency of the internal oscillator of pulse width modulator 4 in turn controls the frequency of the output pulses from Outputs A and B (pins 11 and 14) of the pulse width modulator 4, which in turn control the switching of power to the fluorescent tube 26 as will be explained later in more detail. Thus, the values of oscillator resistor 20 and oscillator capacitor 22 are chosen to provide the desired frequency of power switching at fluorescent tube 26.

The power switches 6 and 8 are alternately actuated by the signals at control terminals 29 and 33 respectively. In operation, power switch 6 is actuated first, so that DC current flows from DC source 36 through resonant inductor 10, load 26, and resonant capacitor 12, charging blocking capacitor 14. Power switch 6 is then deactuated. After a brief period of time, power switch 8 is actuated, so that stored charge flows from blocking capacitor 14 through load 26, resonant capacitor 12, and resonant inductor 10 to ground, thus discharging blocking capacitor 14. After a brief time delay this cycle is repeated, with the repetition at a constant frequency determined by the values of oscillator resistor 20 and oscillator capacitor 22 as explained previously. The repetition of this switching operation produces an alternating current flow through load 26. When the load 26 is a fluorescent tube, this current flow will excite the internal gases of the tube, causing the tube to glow.

The amount of time between repetitions of the cycle is determined by the duty cycle of the control pulses produced by pulse width modulator 4 and transmitted to control terminals 29 and 33. As the duty cycle of the control pulses increases, the duty cycle of power applied to the load 26 will increase, increasing the apparent brightness of the fluorescent tube 26. Conversely, as the duty cycle of the control pulses decreases, the apparent brightness of the fluorescent tube 26 will decrease. Thus, the circuit produces a dimming function.

The duty cycle of the control pulses produced by pulse width modulator 4 is varied by varying the voltage applied to the non-inverting input 17 of pulse width modulator 4. In the circuit shown in FIG. 1, this voltage can be varied by adjusting the variable resistor 18 to produce the desired voltage drop across voltage divider resistor 16, which is connected to a reference voltage Vref (pin 16) of the pulse wave modulator 4.

The circuit of the present invention will now be described in detail. Generally, this circuit provides a new and improved alternative to the previously described method of controlling the brightness of the load 26 by adjusting variable resistor 18. The operation of the circuit of the present invention can be understood fully without further reference to the internal function of the pulse width modulator 4, although a complete description of this internal operation is contained in the inventor's other applications previously referenced and incorporated herein.

Figure 2:
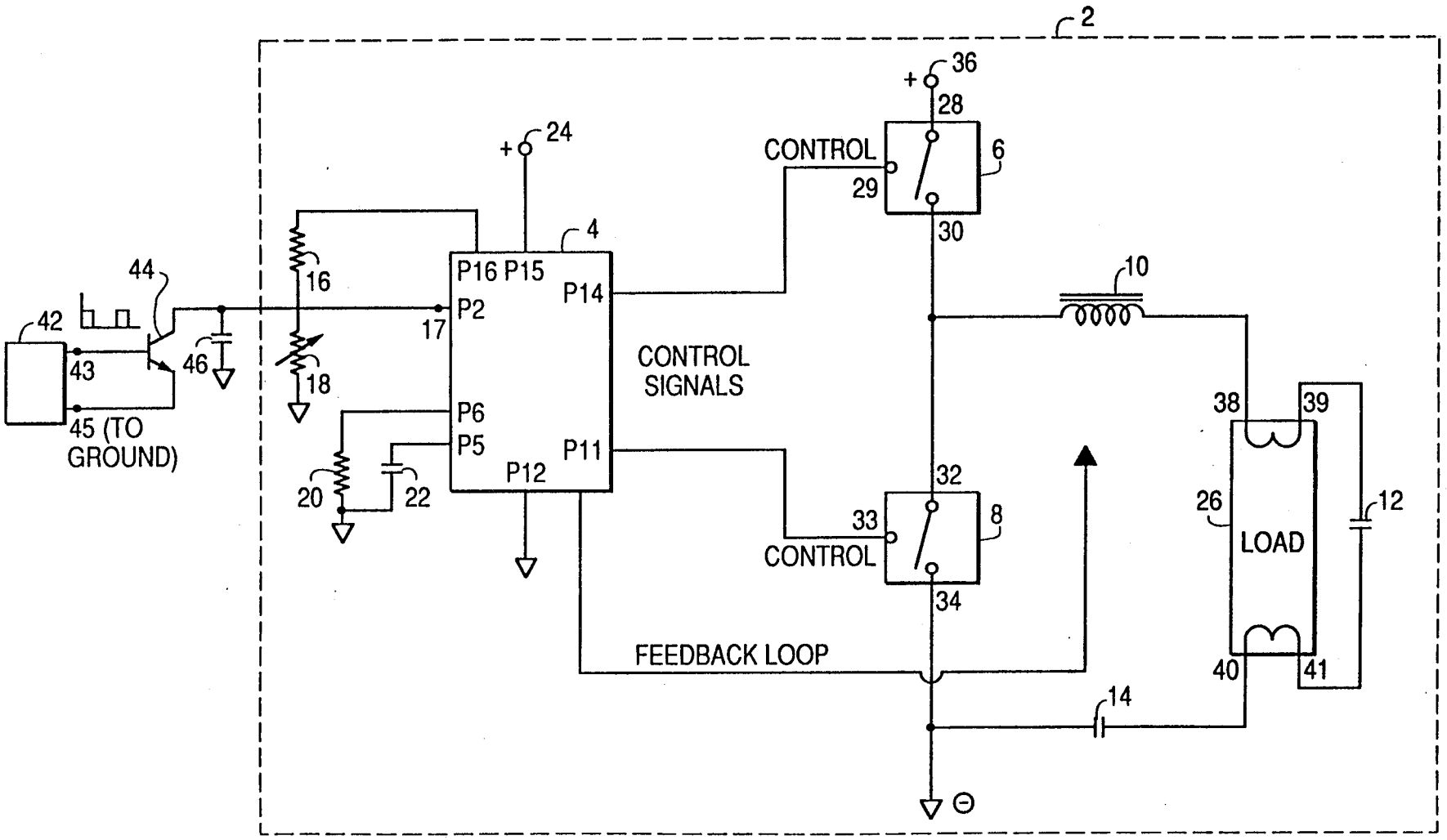
FIG. 2 is a circuit diagram showing direct connection of the dimming control circuit of the present invention.

First, the interface between the circuit of the present invention and the resonant inverter solid-state ballast 2 will be described. Referring now to FIG. 2, the new and improved pulse generating circuit is shown generally at 42 (this circuit will be described later in full detail). The output 43 of this circuit is connected to the base of an output transistor 44. The collector of an output transistor 44 is connected to non-inverting input 17 of pulse width modulator 4, while the emitter of output transistor 44 is connected to ground. An integrating capacitor 46 is connected between the non-inverting input 17 and ground. The pulse generating circuit 42 preferably generates a variable duty cycle, square wave pulse train at a fixed frequency greater than 1 kHz.

The output pulses at output 43 control the charging of integrating capacitor 46. When pulse generating circuit 42 produces a pulse at output 43, the voltage applied to the base of transistor 44 turns on transistor 44, allowing current to flow from the collector to the emitter of the transistor 44. Because the collector of transistor 44 is connected to the capacitor 46 and the non-inverting input 17, and since the emitter of transistor 44 is connected to ground, a pulse from pulse generating circuit 42 effectively grounds the integrating capacitor 46, tending to discharge the capacitor 46. When output 43 is not producing a pulse, transistor 44 is turned off, and integrating capacitor 46 tends to charge to the level of the voltage drop across variable resistor 18 as determined by the voltage divider comprising resistor 16 and variable resistor 18.

The voltage at non-inverting input 17 varies with the duty cycle of the pulses at output 43. Since the output 43 produces a series of pulses at high frequency, the pulses produce a periodic pull up and down of the DC level across integrating capacitor 46. The integrating capacitor 46 integrates over time the DC level shift produced by the pulsed output 43, so that for a given pulse duty cycle, a continuous DC voltage appears at non-inverting input 17. The DC voltage at non-inverting input 17 will vary with the duty cycle of the pulsed output 43 in the following manner. As the duty cycle increases, the capacitor 46 will be grounded for a relatively greater portion of time, and the voltage at non-inverting input 17 will be reduced. Conversely, as the duty cycle of pulses at output 43 is reduced, the voltage at non-inverting input 17 will be increased.

Because the voltage level at non-inverting input 17 controls the apparent brightness of load 26, those skilled in the art will immediately appreciate that the light output of load 26 can be adjusted by varying the duty cycle of the pulses at output 43. Thus, a novel and unique method of controlling a solid-state dimming ballast by varying the duty cycle of a pulsed input has been disclosed.

Figure 3:
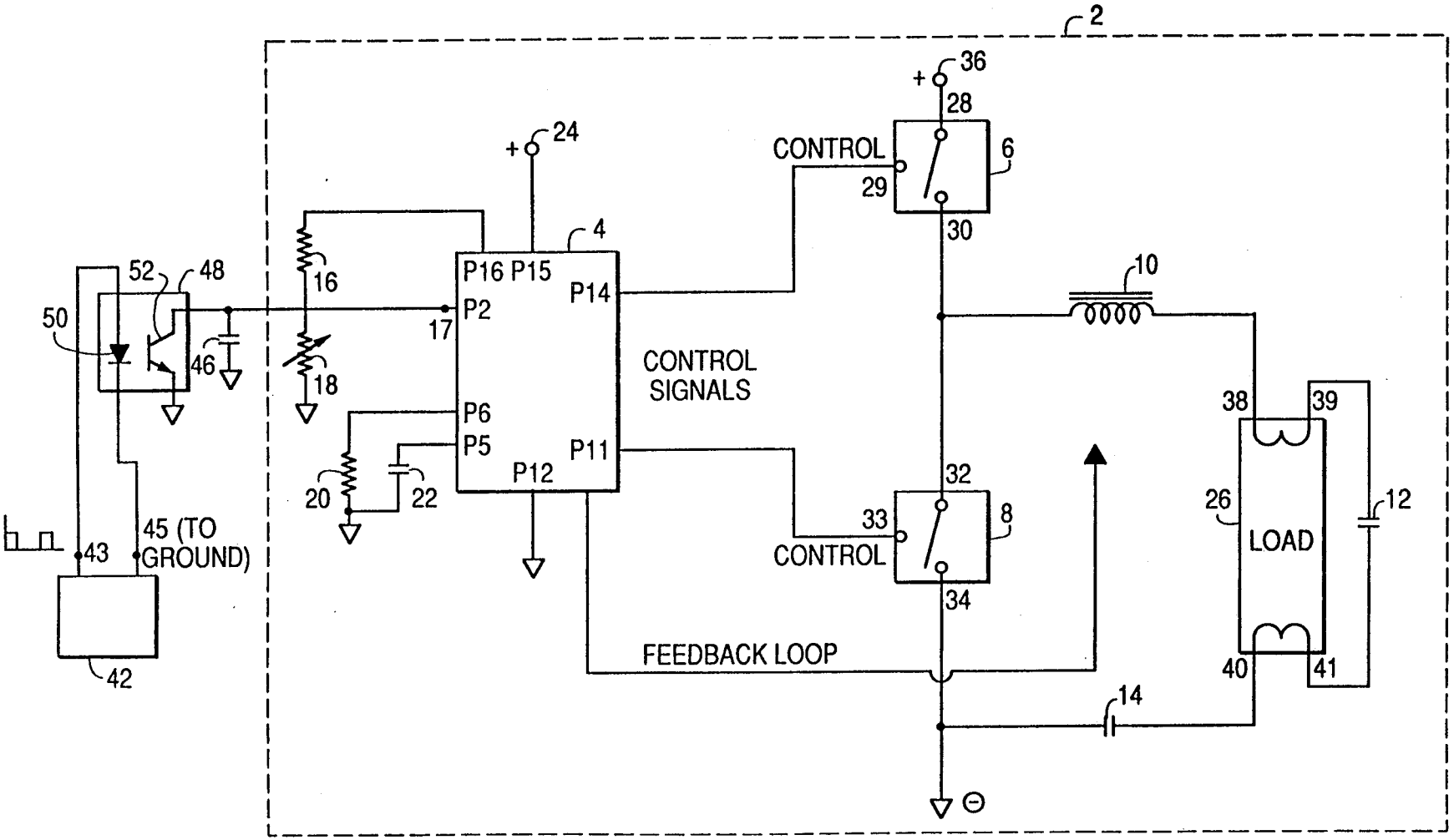
FIG. 3 is a circuit diagram of the solid-state electronic ballast circuit showing the dimming control circuit of the present invention connected by an optocoupler.

FIG. 3 shows a preferred embodiment of the circuit of FIG. 2 wherein the output transistor 44 is replaced by a conventional opto-isolator 48. The opto-isolator 48 comprises a light-emitting diode (LED) 50 and a phototransistor 52. The light-emitting diode 50 is connected between output 43 and ground. The phototransistor 52 has its collector connected to non-inverting input 17 and its emitter connected to ground. The phototransistor 52 turns on in response to light emissions from LED 50, which operates in response to the pulses from output 43. This embodiment thus operates in substantially the same manner as the embodiment shown in FIG. 2. However, the opto-isolator 48 electrically isolates the ballast 2 from the pulse generating circuitry 42. The ballast circuitry may contain large voltages and current, and as will be seen, controls for the pulse generating circuit 42 will be handled by human operators. Therefore, this electrical isolation provides a substantial safety benefit.

Figure 4:
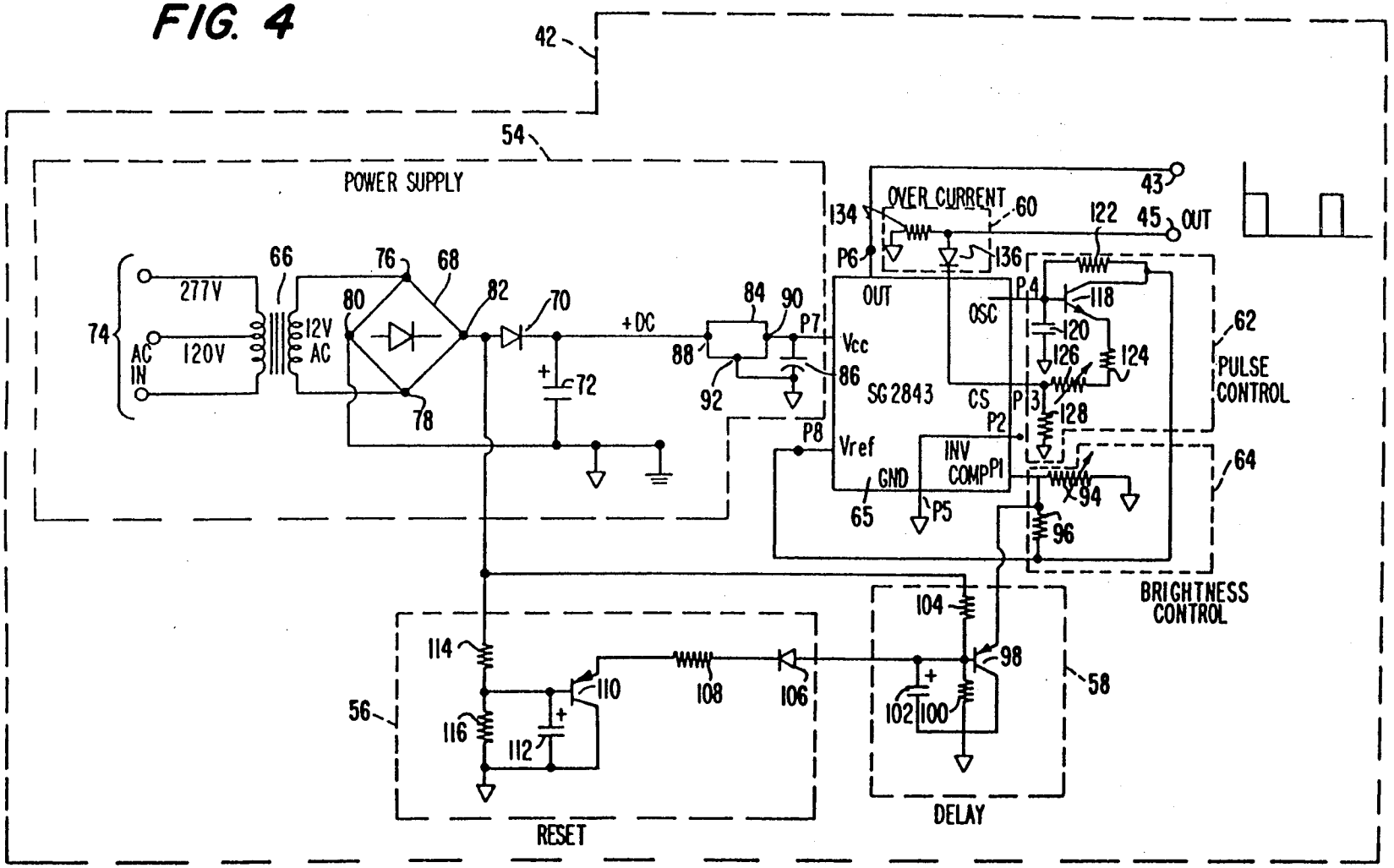
FIG. 4 is a circuit diagram of the dimming circuit of the present invention.

The circuit and operation of the novel pulse generating circuit 42 will now be described in detail. As shown in FIG. 4, the pulse generating circuit 42 comprises a power supply section 54, a reset section 56, a delay section 58, an overcurrent section 60, a pulse control section 62, a brightness control section 64, and a variable duty cycle frequency source 65.

The variable duty cycle frequency source 65 may preferably be an UC2843 integrated circuit manufactured by Motorola, although other integrated circuits could be used or a circuit could be constructed to perform the necessary functions. The operation of the frequency source 65 is described in detail in Motorola publications which will be familiar and accessible to those skilled in the art. However, the functions of the pins used in this circuit are described in Table 1 in sufficient detail to permit those skilled in the art to understand the circuit and to practice the invention disclosed.

TABLE 1

Pin Connections of UC2843 Frequency Source

| PIN | NAME | DESCRIPTION |
|---|---|---|
| 1 | Compensation | Voltage may be applied externally to vary the duty cycle of the pulses. |
| 2 | Inv. Input | Not Used (connected to ground). |
| 3 | Current Sense | Inhibits pulse output if more than one volt is applied externally. |
| 4 | OSC | Provides sawtooth wave output with frequency depending on external circuitry. |
| 5 | Ground | Connected to ground. |
| 6 | Output | Produces variable duty cycle pulse output with frequency depending on external circuitry connected to OSC terminal and duty cycle depending on voltage applied to Compensation terminal. |
| 7 | Vcc | Power supply (+12 v DC). |
| 8 | Vref | Reference voltage output (5.1 v DC). |

Referring again to FIG. 4, the power supply section 54 comprises a transformer 66, a full-wave bridge rectifier 68, a capacitor isolation diode 70, and a smoothing capacitor 72. The power supply section 54 is preferably also provided with a conventional three-terminal 12 volt voltage regulator 84 and an associated capacitor 86. The voltage regulator 84 has an input terminal 88, an output terminal 90, and a ground terminal 92.

Alternating current input from an AC source 74 is connected to the primary coil of transformer 66. The turns ratio of transformer 66 is selected with reference to the voltage of AC source 74 so that 12 volts AC is produced on the secondary coil. Full-wave bridge rectifier 68 is a conventional device. The rectifier 68 has two input terminals 75 and 78 and two output terminals 80 and 82. The two terminals of the secondary coil of transformer 66 are connected respectively to input terminals 75 and 78 of rectifier 68. Output terminal 80 of rectifier 58 is connected to circuit and Earth ground, while output terminal 82 is connected to the anode of isolation diode 70 and provides a rectified 12 volt DC output thereto. The cathode of diode 70 is connected to the input terminal 88 of regulator 84 and to the positive terminal of smoothing capacitor 72. The negative terminal of smoothing capacitor 72 is connected to both circuit ground and Earth ground.

The output terminal 90 of regulator 84 is connected to Vcc (pin 7) of variable duty cycle frequency source 65, and ground terminal 92 is connected to ground. The capacitor 86 is connected between the output terminal 92 of regulator 84 and ground. The voltage regulator 84 compensates for variations in the voltage of AC source 74, thus stabilizing the 12 volt DC power provided to the integrated circuits of frequency source 65. A stable voltage supply for frequency source 65 is necessary to avoid variations in the pulse signal output 43 of the frequency source 65.

Preferably, the 12 volt DC regulated output at output terminal 90 of regulator 84 will be used as the DC source 24 connected to Vcc of the pulse width modulator 4 (shown in FIG. 2). In this way, the entire circuit may be controlled by a single power switch (not shown in the drawings). This switch may be any conventional switch and may be installed in the power supply circuitry in a number of ways which are conventional and will be immediately apparent to those skilled in the art.

The brightness control section 64 comprises a variable resistor 94 and a voltage divider resistor 96. The variable resistor 94 is connected between the compensation pin (pin 1) of frequency source 65 and ground. The voltage divider resistor 96 is connected between Vref (pin 8) of frequency source 65 and the compensation pin (pin 1) of frequency source 65. Vref (pin 8) of frequency source 65 provides a constant 5.1 volt DC signal. Thus, the variable resistor 94 and resistor 96 form a voltage divider so that, as the variable resistor 94 is adjusted, the voltage applied to the compensation pin (pin 1) of frequency source 65 will vary. As described in the table of FIG. 5, the voltage on the compensation pin (pin 1) of frequency source 65 controls the duty cycle of the pulses produced at output 43, the duty cycle determining the brightness of the load 26 as described previously with reference to FIG. 2.

The power supply switch previously described may be integrated with the variable resistor 94 in a manner well known in the art.

The delay section 58 comprises a PNP transistor 98, a resistor 100, capacitor 102, and resistor 104. The emitter of transistor 98 is connected to the compensation terminal (pin 1) of frequency source 65, while the collector of transistor 98 is connected to ground. The base of transistor 98 is connected to one terminal of resistor 104, the other terminal of the resistor 104 being connected to the output terminal 82 of bridge rectifier 68. The positive terminal of capacitor 102 is connected to the base of transistor 98, while the negative terminal of capacitor 102 is connected to ground. Resistor 100 is connected between the base of transistor 98 and ground.

As will be seen, the delay section 58 provides novel and uniquely advantageous operation because, in operation, the delay section 58 suppresses transmission of the dimming signal 43 at power-up. With the dimming signal suppressed by delay section 58, the tube 26 (shown in FIG. 2) is started at full brightness. Full-brightness starting is essential for two reasons: First, full-brightness starting prolongs the life of the fluorescent tubes. Second, fluorescent tubes may not start at all if power is not provided for the full duty cycle.

The operation of delay section 58 to suppress the dimming signal 43 will now be described in detail. When no power is applied to the circuit 42 from AC source 74, the transistor 98 will conduct fully, thus effectively grounding the compensation terminal (pin 1) of frequency source 65. When the compensation terminal is grounded in this manner, a zero duty cycle at output 43 is selected. As explained previously, the brightness of the load 26 (shown in FIG. 2) varies inversely with the duty cycle of the pulsed output 43. A zero duty cycle of the pulsed output 43 corresponds to full brightness at the load 26 (shown in FIG. 2). Therefore, when the transistor 98 is fully conductive, the load 26 will be at maximum brightness.

When power is applied to the circuit 42, the capacitor 102 will charge according to a time constant determined by the values of resistors 100 and 104 and capacitor 102. As the capacitor 102 charges, the transistor 98 will be rendered less conductive, until the transistor 98 ceases to conduct. When the transistor 98 ceases to conduct, the delay section 58 will have no effect on the voltage at the compensation pin (pin 1) of frequency source 65. The voltage at the compensation pin (pin 1) will then be controlled entirely by the brightness control section 64.

Thus, when power is applied to the circuit 42 and the resonant inverter solid-state ballast circuit 2 (shown in FIG. 1), the delay section 58 will initially inhibit any dimming of the load 26 (as shown in FIG. 1), regardless of the setting of variable resistor 94 (the brightness control). The load 26 will "start" at full brightness. After a brief period of time, the delay section 58 will cease to inhibit dimming and the load 26 will dim to the level selected by means of variable resistor 94. An important feature of the present invention is that the fluorescent lamp 26 does not come on at full brightness and then suddenly become dim; the steadily increasing voltage across capacitor 102 as it charges reduces the conductance of transistor 98 steadily over a brief period of time. The voltage at the compensation pin (pin 1) of frequency source 65 will therefore increase steadily from zero to the level determined by the setting of variable resistor 94. As a result, the fluorescent lamp 26 will come on at full brightness, and then dim to the preset level in a smooth and pleasing manner.

Of course, the length of the delay produced by delay section 58 can be adjusted by changing the value of resistors 100 and 104 and capacitor 102 in accordance with well-known time constant principles.

During a power failure, fluorescent lamp 26 will be extinguished. If the power failure is brief, the capacitor 102 may retain its charge, so that delay section 58 will not provide the desired full-brightness startup and transition to the set dimming level as described. As explained previously, the lamp 26 may not start at a low-brightness setting, and even if the lamp 26 does start, its life will be shortened by a low-intensity startup. Reset section 56 operates to reset the delay section 58 during a power failure, preparing delay section 58 to operate properly when power is returned to the circuit.

Reset section 56 comprises a diode 106, resistor 108, PNP transistor 110, filter capacitor 112, and voltage divider resistors 114 and 116. The anode of diode 106 is connected to the base of delay section transistor 98, and the cathode of diode 106 is connected to one terminal of resistor 108. The other terminal of resistor 108 is connected to the emitter of transistor 110. Resistor 108 preferably has a small value, in the range of 5-7 Ohms. The collector of transistor 110 is connected to ground. The positive terminal of filter capacitor 112 is connected to the base of transistor 110, while the negative terminal of the capacitor 112 is connected to ground. One terminal of resistor 114 is connected to the output terminal 82 of full-wave bridge rectifier 68, while the other terminal of the resistor 114 is connected to the base of transistor 110. Resistor 116 is connected between the base of transistor 110 and ground.

Resistors 114 and 116 together form a voltage divider which determines the voltage at the base of transistor 110. The values of resistors 114 and 116 are chosen with reference to the values of resistors 100 and 104 so that transistor 110 does not conduct while AC power source 74 is providing power to the circuit 42. The value of capacitor 112 is chosen with reference to the values of resistors 114 and 116 so that, if power is removed from the circuit, capacitor 112 will discharge through resistor 116 in about 1 millisecond.

If a failure of power from AC source 74 occurs, the reset section 56 operates as follows: The voltage at the base of transistor 110 falls to zero within one millisecond as the capacitor 112 discharges through resistor 116. Because delay section capacitor 102 is still charged, the voltage at the emitter of transistor 110 is considerably greater than zero. Therefore, transistor 110 begins to conduct, effectively shorting and discharging the delay section capacitor 102. Thus, the reset section 56 quickly prepares the delay section 58 so that the fluorescent tube 26 may be restarted automatically at full brightness as described previously.

It should be noted that the diode 70 is provided in the power supply section 54 to isolate the reset section 56 from filter capacitor 72 so that, during a power interruption, filter capacitor 72 will not discharge through the reset section 56 and prevent proper operation of the reset section 56.

The pulse control section 62 determines the frequency of the pulsed output 43 and limits the maximum duty cycle of said output pulses. Pulse control section 62 comprises NPN transistor 118, frequency set capacitor 120, frequency set resistor 122, resistor 124, variable resistor 126, and resistor 128. The base of transistor 118 is connected to the oscillator terminal (pin 4) of frequency source 65. The collector of transistor 118 is connected to Vref (pin 8) of frequency source 65, and the emitter of transistor 118 is connected to one of the two terminals of resistor 124. The other terminal of resistor 124 is connected to one of the two terminals of variable resistor 126. The other terminal of variable resistor 126 is connected to the current sense terminal (pin 3) of frequency source 65. The resistor 128 is connected between the current sense terminal (pin 3) of frequency source 65 and ground. The frequency set resistor 122 is connected between the oscillator terminal (pin 4) of frequency source 65, and Vref (pin 8) of frequency source 65. The frequency set capacitor 120 is connected between the oscillator terminal (pin 4) of frequency source 65 and ground.

The oscillator terminal (pin 4) of the frequency source 65 will produce a ramp signal (sawtooth wave) with a DC offset, the frequency of the ramp signal depending on a time constant determined by the values of frequency set resistor 122 and frequency set capacitor 120. Preferably, the resistor 122 and capacitor 120 will be chosen so that the frequency of the ramp signal is greater than 1 kiloHertz.

The ramp signal from the oscillator terminal (pin 4) of frequency source 65 is transmitted by means of the transistor 118 to a voltage divider formed by resistors 124 and 128 and the variable resistor 126. The operation of these voltage divider resistors causes the signal on the current sense terminal (pin 3) of frequency source 65 to be at all times a percentage of the varying voltage at the oscillator terminal (pin 4) of frequency source 65. The percentage or fraction of the oscillator terminal output that will appear at the current sense terminal (pin 3) is determined by the setting of variable resistor 126. The peak voltage output of the oscillator terminal (pin 4) of an UC2843 integrated circuit is approximately 2.8 volts; the minimum voltage output (D.C. offset) is 1.2 volts. Preferably, resistors 124 and 128 and the setting of variable resistor 126 are chosen so that the peak voltage applied to the current sense terminal (pin 3) will be approximately 1.4 volts.

The frequency source 65 will inhibit generation of a pulse signal at output 43 whenever the voltage applied to the current sense terminal (pin 3) is greater than about one volt. Therefore, the effect of applying a high frequency ramp signal to the current sense terminal (pin 3) is to suppress pulse generation during a portion of each ramp cycle.

Figure 5:
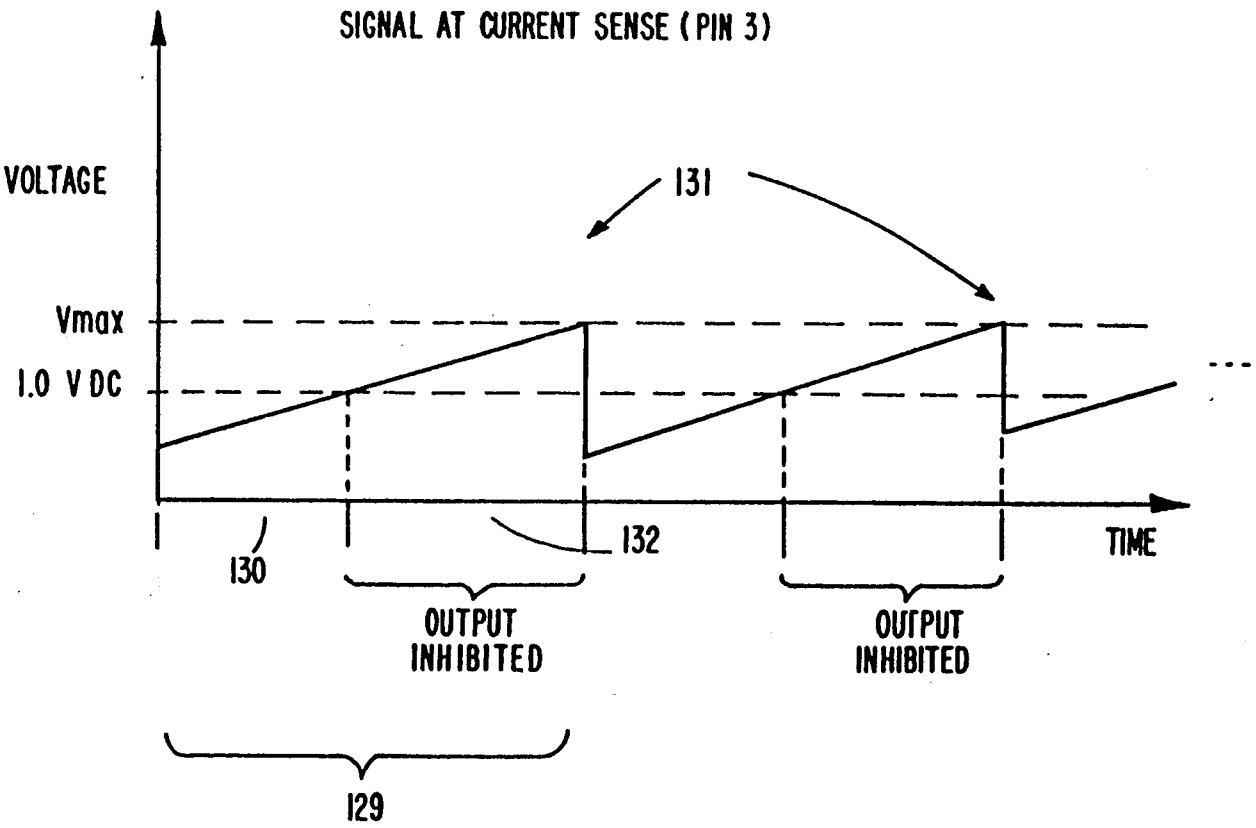
FIG. 5 is a graph of the waveform applied to the current sense terminal of the UC2843 by circuitry of the present invention.

Referring now to FIG. 5, a portion of a typical ramp signal 131 as applied to the current sense terminal (pin 3) is shown. The ramp signal 131 has a peak voltage Vmax. As explained previously, due to the action of the voltage divider comprising resistors 124, 126, and 128, Vmax is a fraction of the peak voltage of the ramp signal at the oscillator terminal (pin 4) of frequency source 65. As stated, Vmax is preferably about 1.4 volts. In the drawing, a single ramp cycle 129 takes place over a time period encompassing a first time period 130 and a second time period 132. In the time period 130, the voltage of the ramp signal rises from 0.6 volts to one volt; during this period 130, the frequency source 65 is not inhibited form transmitting a pulse at output 43. Of course, whether a pulse is transmitted by frequency source 65 and the actual duration of any pulse transmitted are determined by brightness control section 64, delay section 58, and reset section 56 in the manner explained previously. During the second time period 132, the voltage of the ramp signal 131 applied to the current sense terminal (pin 3) exceeds one volt, and the frequency source 65 is inhibited from producing any signal at output 43. Thus, the application of the ramp signal 131 to the current sense terminal (pin 3) limits the maximum duty cycle of the pulses at the output 43. In the preferred embodiment described, with Vmax=1.4 volts and with the output 43 inhibited when voltages greater than 1.0 volts are applied to the current sense terminal (pin 3) of frequency source 65, the maximum duty cycle of pulses at output 43 is 50%.

Referring back to FIG. 3, it will be apparent that limiting the pulsed output 43 to a 50% duty cycle places an upper limit on the amount of dimming of the load 26. This limitation is desirable because dimming the load 26 excessively may shorten the life of the load 26 and will in some cases result in an unpleasant flickering effect when the load 26 is a fluorescent tube.

Referring now to FIG. 4, the maximum duty cycle of the pulsed output 43 can be adjusted by means of variable resistor 126, and may be set at a value other than 50% as dictated by the requirements of the consumer or the design parameters of the ballast 2 (shown in FIG. 3).

The overcurrent section 60 is a protective circuit that disables pulsed output 43 if excessive current is drawn from the output 43. Overcurrent section 60 comprises a resistor 134 and a diode 136. The anode of diode 136 is connected to an output reference 45 which may serve as the ground reference for the output signal 43. The cathode of diode 136 is connected to the current sense terminal (pin 3) of frequency source 65. The resistor 134 is connected between the anode of diode 136 and ground. The diode 136 prevents transmission of the ramp signal at the current sense terminal (pin 3) to the output reference 45.

As explained previously, the output 43 of frequency source 65 is inhibited when more than one volt is applied to the current sense terminal (pin 3).

The voltage drop across diode 136 is approximately 0.6 volts; therefore the output 43 will be inhibited if the voltage at the anode of diode 136 is greater than 1.6 volts. This condition will occur when the voltage drop across resistor 134 is greater than 1.6 volts. Preferably, resistor 134 may be a 4.7 Ohm resistor, so that when more than 0.34 Amperes of current is drawn from output 43, the voltage drop across resistor 134 will be greater than 1.6 volts and the output 43 will be disabled. Thus, the overcurrent section 60 prevents damage to the circuit of the present invention.

Of course, each ballast 2 connected to the pulse generating circuit 42 will draw current, so that there is a practical limit to the number of ballasts 2 that can be controlled by a single pulse generating circuit 42. The pulse generating circuit as disclosed will drive approximately 16 ballasts without exceeding 0.34 Amp current draw from output 43. However, if it is desired to control more than 16 ballasts 2 using one pulse generating circuit 42, an NPN power transistor can be used to increase the fanout capability of the circuit 42. The base of the power transistor may be connected to the output 43, while the collector of the power transistor is connected to a DC power source such as that provided at Vcc (pin 7) of frequency source 65. The pulse signal output to the ballasts 2 is then taken at the emitter of the power transistor. The fanout capability of the circuit 42 can be expanded to allow control of almost any number of ballasts 2 using well-known techniques.

I claim:

1. A control circuit for controlling a power circuit wherein the power circuit supplies power variably to a fluorescent lamp load in response to the level of a variable control input voltage applied to a control input, said control circuit comprising control pulse generating means for generating control pulses of variable duty cycle; brightness control means connected to the control pulse generating means for setting the desired brightness of the load; integrating means for integrating the control pulses over time to produce the variable control input voltage; said integrating means being connected to the power circuit control input and said control pulse generating means being connected to the integrating means, and delay means for providing a blocking period during starting of the fluorescent lamp, during which period the delay means operates to block transmission of control pulses to the integrating means, the delay means thereafter allowing transmission of the control pulses so that the brightness of the lamp is set at the level selected by the brightness control means;

wherein the control pulse generating means varies the duty cycle of the control pulses with the setting of the brightness control means and the power circuit supplies alternating current power to the fluorescent lamp, the duty cycle of said alternating current power being variable in response to the variable control input voltage, and wherein the duty cycle of the control pulse is inversely related to the brightness level selected by the brightness control means; and wherein at the end of the blocking period the delay means operates to steadily increase the duty cycle of the control pulses until said control pulse duty cycle produces the lamp brightness level selected by the brightness control means.

2. A control circuit for controlling a power circuit wherein the power circuit supplies power variably to a fluorescent lamp load in response to a signal at a control input, said control circuit comprising dimming signal generating means connected to the power circuit control input for generating a dimming signal representative of the desired load brightness level; brightness control means connected to the dimming signal generating means for setting the desired load brightness level; and delay means for providing a starting period during starting of the load, during which starting period the delay means causes the dimming signal generating means to transmit a dimming signal representative of brightness sufficient to start the load even though the level selected by the brightness control means may not be sufficient to start the load, the delay means thereafter operating to steadily modify the dimming signal until said dimming signal produces the load brightness level selected by the brightness control means.

3. The control circuit of claim 2 further including reset means responsive to a loss of power to the control circuit and operating to reset the delay means so that the delay means operates in accordance with its function when power to the control circuit is restored.

4. The control circuit of claim 2 further including limiting means to restrict the minimum load brightness level that can be selected by the dimming signal.

5. The control circuit of claim 4, wherein the limiting means includes adjustment means permitting variation of the minimum load brightness level that can be selected by the dimming signal.

6. The control circuit of claim 2 further including a current limiting means for inhibiting the operation of the dimming signal generating means if current in excess of a selected value is drawn from the output thereof.

7. A circuit for controlling a fluorescent lamp power circuit supplying power to a fluorescent lamp load of variable brightness, comprising: brightness control means attached to the power circuit for setting the desired brightness of the lamp load and delay means for providing a starting period during starting of the load; wherein during the starting period the delay means causes the power circuit to supply power to the load sufficient to start the load, regardless of the level selected by the brightness control means, thereafter allowing the power circuit to supply power to the load to provide the brightness level selected by the brightness control means, wherein at the end of the starting period the power circuit steadily modifies the brightness of the lamp load until the load brightness matches the level selected by the brightness control means.

8. The circuit of claim 7 further including reset means responsive to a loss of power to the power circuit and operating to reset the delay means so that the delay means operates in accordance with its function when power to the power circuit is restored.

9. A method for controlling the operation of a fluorescent lamp power circuit having a control input, wherein said power circuit supplies power to a fluorescent lamp load of variable brightness, the brightness of said load being variable in response to a control voltage applied to the control input, comprising the steps of:

a. Generating a series of control pulses of variable duty cycle, the duty cycle of the control pulses being related to the desired brightness of the load, the desired brightness of the load being specified by adjustment of a brightness control, wherein the series of control pulses of variable duty cycle are generated using an integrated circuit pulse width modulator appropriately configured to respond to the adjustment of the brightness control to generate pulses of the desired duty cycle;

b. Integrating said pulses over time to produce a control voltage; and c. Applying said control voltage to the control input of the power circuit to control the brightness of the load.

10. A control circuit for controlling a power circuit wherein the power circuit supplies power variably to a fluorescent lamp load in response to the level of a variable control input voltage applied to a control input, said control circuit comprising control pulse generating means for generating control pulses of variable duty cycle; brightness control means connected to the control pulse generating means for setting the desired brightness of the load; and integrating means for integrating the control pulses over time to produce the variable control input voltage; said integrating means being connected to the power circuit control input and said control pulse generating means being connected to the integrating means, wherein the control pulse generating means varies the duty cycle of the control pulses with the setting of the brightness control means;

wherein the control pulse generating means comprises a single integrated circuit pulse width modulator appropriately configured to generate in response to said setting of said brightness control means to produce said control pulses.

* * * * *